US009387574B2

(12) United States Patent
East

(10) Patent No.: US 9,387,574 B2
(45) Date of Patent: Jul. 12, 2016

(54) SOCKET DISC TOOL

(71) Applicant: Gordon H. East, Salem, SC (US)

(72) Inventor: Gordon H. East, Salem, SC (US)

( * ) Notice: Subject to any disclaimer, the term of this patent is extended or adjusted under 35 U.S.C. 154(b) by 325 days.

(21) Appl. No.: 14/203,582

(22) Filed: Mar. 11, 2014

(65) Prior Publication Data

US 2015/0258665 A1 Sep. 17, 2015

(51) Int. Cl.
*B25B 13/06* (2006.01)
*B25B 23/00* (2006.01)
*B25B 13/48* (2006.01)

(52) U.S. Cl.
CPC ..... *B25B 13/065* (2013.01); *B25B 13/48* (2013.01)

(58) Field of Classification Search
CPC ..... B25B 13/065; B25B 13/48; B25B 23/00; B25B 23/0035; B25B 13/06
See application file for complete search history.

(56) References Cited

U.S. PATENT DOCUMENTS 1,054,687 A 3/1913 Grigg
1,941,565 A * 1/1934 Mandl ..... B25B 13/06 173/93.7
2,405,462 A 8/1946 Stair
2,486,022 A 10/1949 Haist et al.
4,253,353 A 3/1981 Symbol
4,562,758 A 1/1986 Stirling
5,297,458 A * 3/1994 Smith ..... B25B 13/06 81/124.2
6,745,649 B1 6/2004 Liao
7,059,424 B2 6/2006 Neal et al.
7,677,143 B1 3/2010 Piserchio
8,061,239 B2 * 11/2011 Farrell ..... A62C 33/00 7/126
8,065,939 B2 * 11/2011 Farrell ..... A62C 33/00 7/138
8,291,794 B2 * 10/2012 Farrell ..... A62C 33/00 7/127
8,485,074 B2 * 7/2013 Farrell ..... A62C 99/00 7/127
8,935,972 B2 * 1/2015 Farrell ..... A62C 99/00 7/138
2002/0092383 A1 * 7/2002 Nezigane ..... B25B 13/06 81/121.1
2004/0221688 A1 11/2004 Liao

* cited by examiner

*Primary Examiner* — David B Thomas
(74) *Attorney, Agent, or Firm* — Memminger E. Wiggins

(57) ABSTRACT

A socket disc tool having a handle and a socket disc comprising a central aperture to receive a fastener, such as a bolt or nut. The socket disc includes a body and is defined by plurality of members extending from the body and away from the central aperture. The members include a concave notch which operatively engages a handle which is used to apply leverage to the socket disc which in turn produces torque to loosen or tighten a fastener. The handle includes at least one slot that is designed to engage the notched members on the socket disc and thereby providing a means to exert torque on a fastener. The configuration of the socket disc and the handle with respect to a fastener permits continuous engagement with a fastener and same direction turning by a simple back and forth motion of the handle.

19 Claims, 4 Drawing Sheets

SOCKET DISC TOOL

FIELD OF THE INVENTION

The present invention relates to socket tools that engage fasteners, and more particularly, a socket disc and a handle that is uniquely configured to loosen or tighten a bolt or nut.

BACKGROUND OF THE INVENTION

Current socket tools come in a variety of shapes and sizes for a variety of uses with some uses being somewhat generic and other uses being directed to a more specific task in a specific environment. Many socket tools are not compact in size as a whole, nor are their individual components compact.

Conventional socket wrenches comprise a socket and a handle in its most basic configuration. The socket has a body of a sufficient length with an aperture on one end configured to receive a fastener and a square hole on the other end of the body to receive a handle. The handle typically has a cubic shaped stud extending from one end to engage a socket and can provide a ratcheting motion once engaged with the socket. In order to use such a conventional socket wrench there must be sufficient space available to allow both the socket and its attached ratchet drive handle to engage the intended fastener and then sufficient space must be available to permit the ratchet drive handle to turn its attached socket. As such, the size characteristics of conventional socket tools create obstacles regarding how and where such tools can be used, how such tools can be transported to a job site, as well as how such tools can be stored when not in use. Another factor that is often related to the size of many socket tools is the weight of such tools. Like size, the weight of most socket tools can create obstacles regarding such tools use, transportation, and storage. As can be appreciated by any user of tools in general, these kinds of tools typically cannot be used in confined spaces which is often a necessity when attempting repairs or maintenance on certain kinds of equipment.

Other types of common tools also present certain limitations regarding their use, transportation, and storage. Conventional boxed-end and open-end wrenches are typically manufactured as a specific sized wrench for a specific sized fastener. Under such physical constraints multiple fasteners will require multiple wrenches since a single wrench will fit only a specific sized fastener. The necessity of such multiple wrenches creates the need for more space regarding the storage of these tools when not in use. Additionally, it will be necessary to transport a variety of different sized wrenches to a job site for use. Another factor that must be taken into consideration with conventional boxed-end and open-end wrenches, as well as socket tools with ratchet driver handles, is length of the handle and the amount of torque that can be exerted on the tool itself as well as the fastener upon which the work is being conducted. The application of too much torque can damage not only the fastener, but it may also cause to the tool itself to fail. The length of the wrench must be compatible with the anticipated amount of torque exerted on a fastener by the wrench. Additionally, boxed-end and open-end wrenches do not provide for a continuous engagement between the wrench and a fastener. The wrench must be removed from the fastener and repositioned on the fastener to continue the tightening or loosening of the fastener. Such discontinuous engagement between the wrench and a fastener can often make tightening or loosening the fastener more difficult.

Accordingly, there remains room for improvement and variation within the art.

SUMMARY OF THE INVENTION

It is at least one aspect of the present embodiments to provide a socket disc tool comprising a plurality of socket discs with each socket disc including a body and a handle which work together to loosen or tighten a fastener. The body of the socket disc has a central aperture that is designed to receive and engage a fastener. It also has a plurality of members that extend outward and away from the body and the central aperture. Each member has a first side that includes a concave notch and a second side having a linear slope. Additionally, each member lies in the same plane as the body of the socket disk. The handle of the socket disc tool has a first slot and a second slot. The first slot is larger than the second slot and both said slots are large enough to accept one of the socket discs. A pair of pins pass through the each slot and are designed and configured to engage a pair of the concave notches located on the socket discs.

It is a further aspect of at least one of the present embodiments to provide a socket disc that has six equally spaced members.

It is still a further aspect of at least one of the present embodiments to provide a group of socket discs having a diameter of 2½ inches and a another group of socket discs having a diameter of 2 inches such that the apertures of one group of the socket discs are configured to engage fasteners having diameters ranging from 20 mm to 40 mm and another group of socket discs also configured to engage fasteners having diameters ranging from 10 mm to 25 mm.

It is a further aspect of at least one of the present embodiments to provide a plurality of socket discs with central apertures configured to receive different kinds of fasteners, such as bolts, lag bolts, nuts or a combination thereof.

It is still a further aspect of at least one of the present embodiments to provide a socket disc tool having a handle with a first slot that has a distal pin extending perpendicularly from a top surface to a bottom surface of the handle on a distal end of the first slot and a proximal pin extending perpendicularly from the top surface to the bottom surface of the handle on a proximal end of the first slot. The handle also includes a second slot with a distal pin extending perpendicularly from the top surface to the bottom surface of the handle on a distal end of the second slot and a proximal pin extending perpendicularly from the top surface to the bottom surface of the handle on a proximal end of the second slot.

It is a further aspect of at least one of the present embodiments to provide a handle with its first slot being operationally designed to engage a socket disc having a diameter of 2½ inches and its second slot being operationally designed to engage a socket disc having a diameter of 2 inches.

It is a further aspect of at least one of the present embodiments to provide a socket disc tool that is durable, but lightweight and provides for compact storage.

It is still a further aspect of at least one of the present embodiments to provide for a method of using a socket disk tool comprising the steps of: providing a plurality of socket discs, each socket disc including a body which has a central aperture designed to receive and engage a fastener selected from the group consisting of bolts, lag bolts, nuts or a combination thereof; a plurality of members extending from the body and away from the aperture, each said member being coplanar to said body and having a first side which is defined by a concave notch and a second side having a linear slope; and a handle including a first end, a second end, a top surface, a bottom surface, a first receiving side, and a second side; a first slot located at the first end of the handle and a second slot located at the second end of the handle, each slot extending through the handle from the first receiving side to the second side, said first slot being larger than said second slot and both said slots being large enough to accept one of said socket discs; said first slot having a pair of pins which pass through said first slot extending from the top surface to the bottom surface, said pair of pins being designed to engage a pair of said concave notches on said socket discs; and said second slot having a pair of pins which pass through said second slot extending from the top surface to the bottom surface, said pair of pins being designed to engage a pair of said concave notches on said socket discs; mating a socket disc to said fastener; engaging said socket disc with said first slot or said second slot of said handle; and applying torque to said fastener to loosen or tighten said fastener.

These and other features, aspects, and advantages of the present invention will become better understood with reference to the following description and appended claims.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, Which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1:
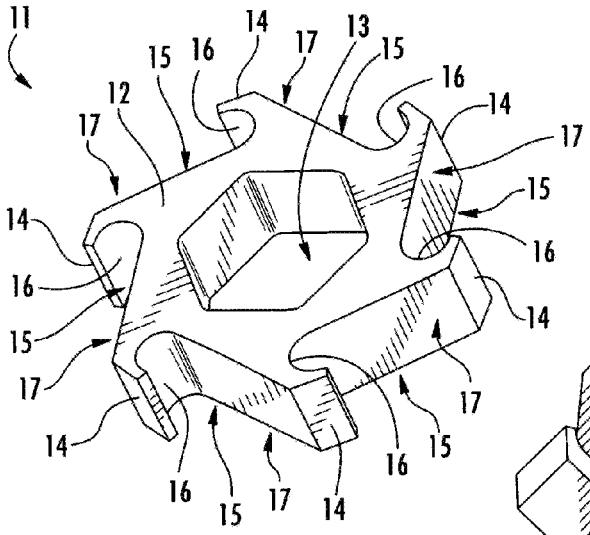
FIG. 1 is a perspective view of a socket disc.
Figure 2:
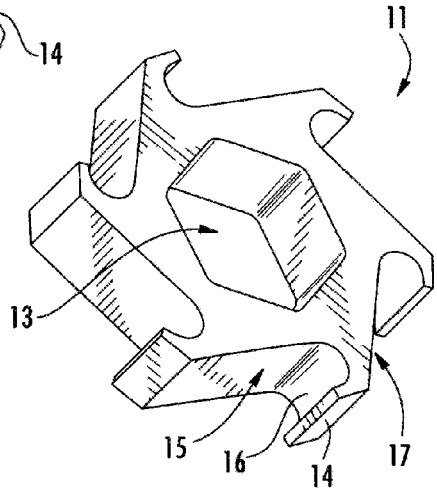
FIG. 2 is an inverted perspective view of the socket disc depicted in FIG. 1.
Figure 3:
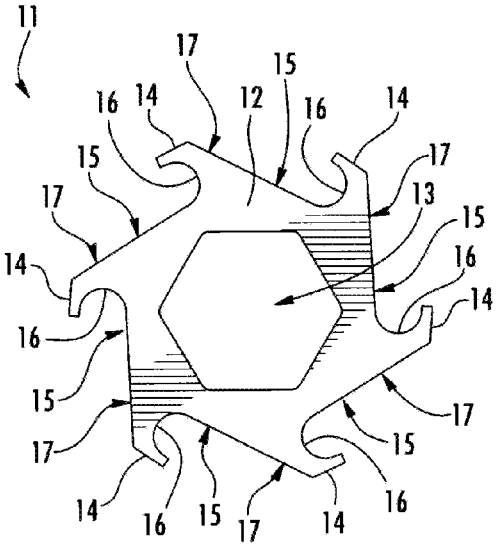
FIG. 3 is a top plan view of a socket disc.
Figure 4:
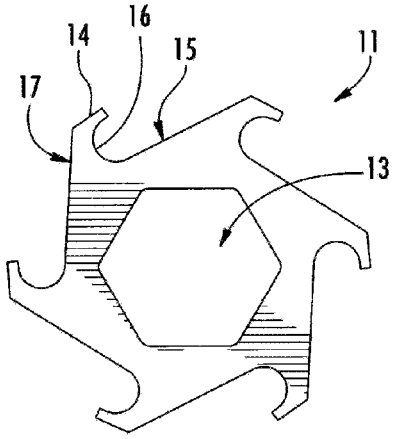
FIG. 4 is an inverted top plan view of the socket disc depicted in FIG. 3.
Figure 5:
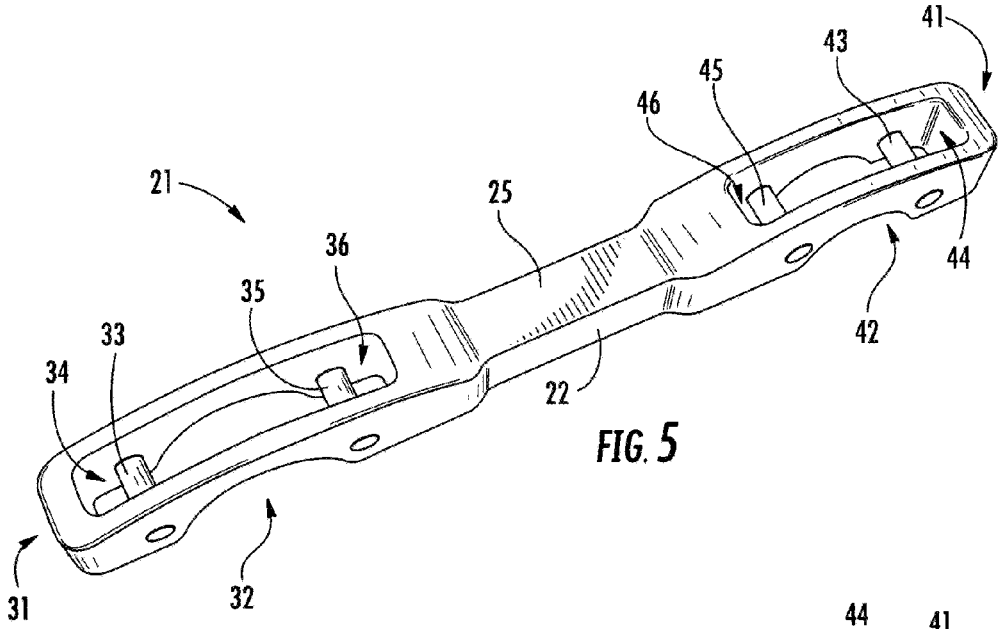
FIG. 5 illustrates a perspective view of a handle.
Figure 6:
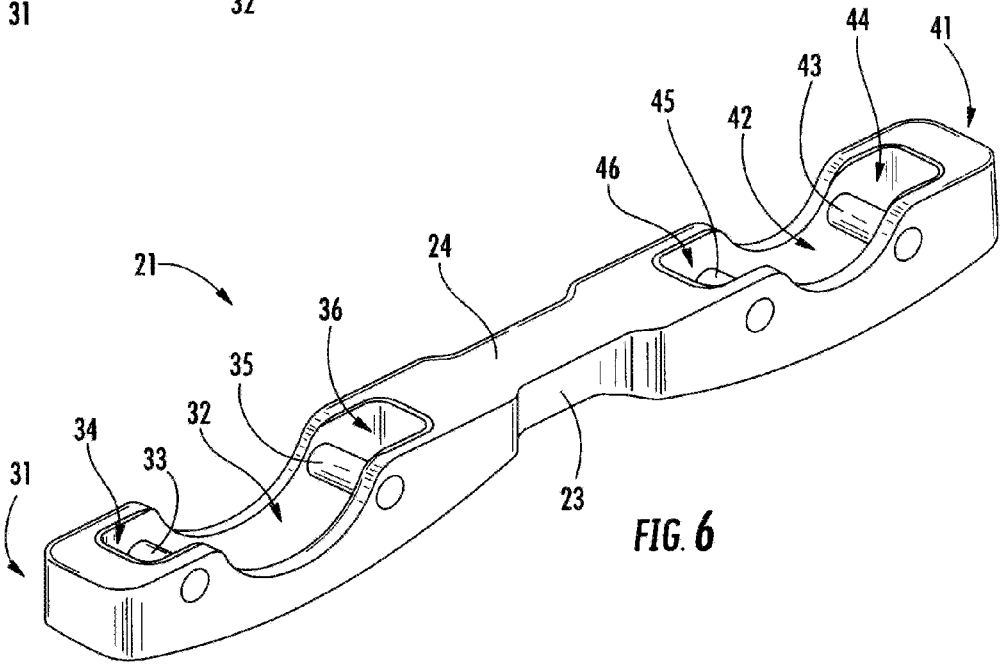
FIG. 6 is an inverted perspective view of the handle depicted in FIG. 5.
Figure 7:
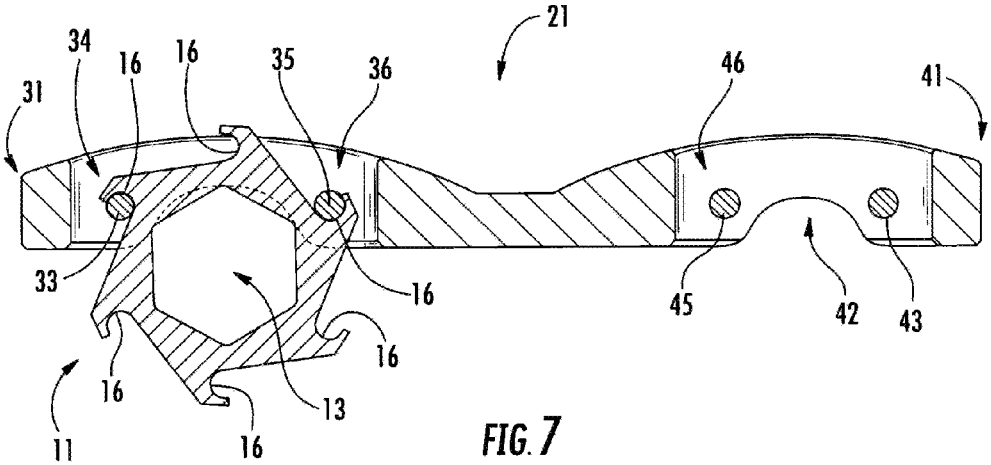
FIG. 7 is an operational plan view in partial cross section of a larger diameter socket disc engaging a handle.
Figure 8:
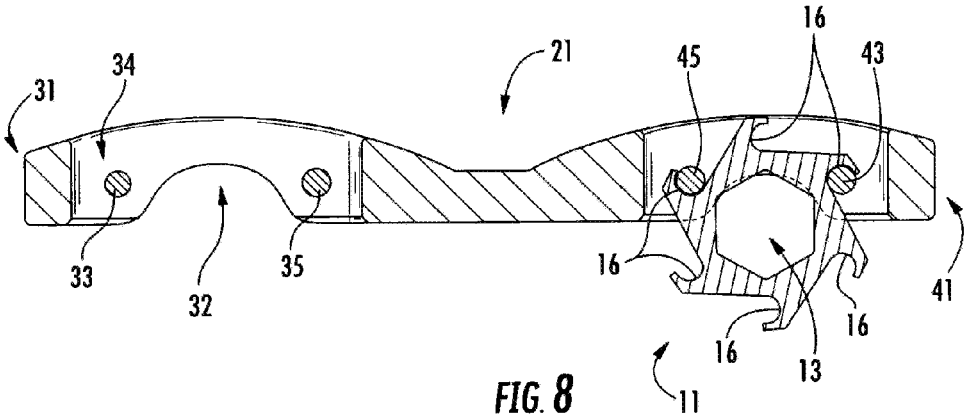
FIG. 8 is an operational plan view in partial cross section of a smaller diameter socket disc engaging a handle.
Figure 9:
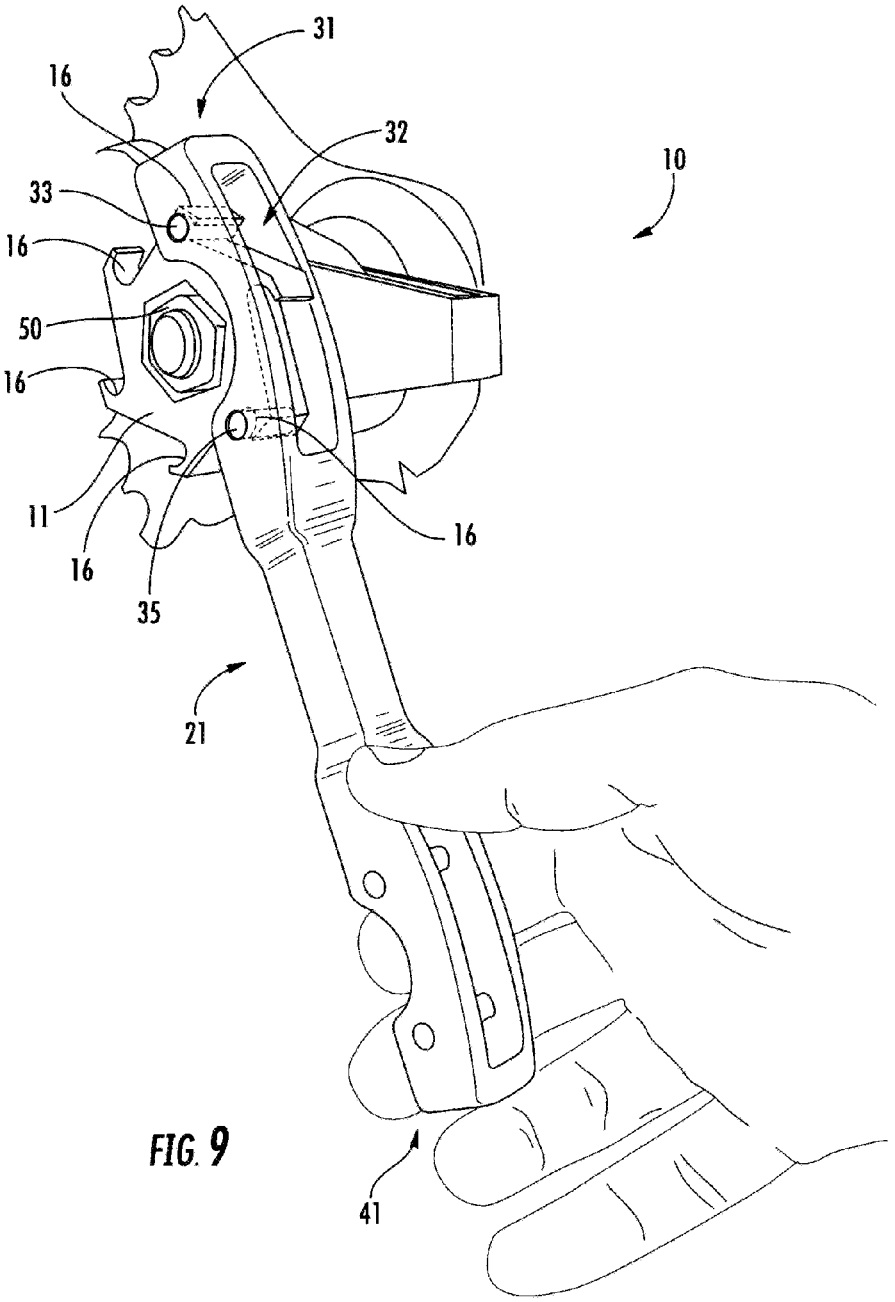
FIG. 9 is a perspective view of a socket disc tool engaging a fastener.

As seen in reference to FIGS. 1 to 9, a socket disc tool 10 is provided. In accordance with the present invention, a socket disc tool comprises a plurality of socket discs 11 as shown in FIGS. 1, 2, 3, and 4. Continuing to refer to FIGS. 1 through 4, each socket disc 11 includes a body 12 that has a central aperture 13. Referring to FIG. 9, the central aperture 13 is designed to receive and engage a fastener 50 when using the present invention to loosen or tighten a fastener. In the preferred embodiment of the present invention the central aperture 13 is designed to receive and engage a fastener selected from the group consisting of bolts, lag bolts, nuts or a combination thereof. Various sizes of fasteners may be adjusted using other embodiments of the present invention by altering the shape and size of the central aperture 13. One embodiment of the present invention includes a first group of socket discs 11 configured to engage fasteners having a diameter in the range of 20 mm to 40 mm and a second group of socket discs 11 being configured to engage fasteners having a diameter in the range of 10 mm to 25 mm. Another exemplary embodiment of the present invention includes a first group of socket discs being configured to engage 32 mm, 27 mm, and 24 mm hexagonal bolts and a second group of socket discs being configured to engage 22 mm, 19 mm, and 17 mm hexagonal bolts. Now referring to FIGS. 1 to 4, the socket disc 11 includes a plurality of members 14 that extend from the body 12 of the socket disc 11 and away from the socket disc's central aperture 13. Each member 14 of a socket disc 11 being coplanar to the socket disc's body 12. Continuing to refer to FIGS. 1 to 4, each member 14 of a socket disc 11 has a first side 15 that is defined by a concave notch 16 and a second side 17 having a linear slope.

Now referring to FIGS. 5, 6, 7, and 8, the present invention comprises a handle 21 having a first end 31, a second end 41, a top surface 22, a bottom surface 23, a first receiving side 24, and a second side 25. The handle 21 also includes a first slot 32 located at the first end 31 of the handle and a second slot 42 located at the second end 41 of the handle. The first slot 32 and the second slot 42 extend through the handle 21 from the first receiving side 24 to the second side 25 with the first slot 32 being larger than the second slot 42, and both slots being large enough to accept one of the socket discs 11. In one embodiment of the present invention, the first slot 32 and the second slot 42 are substantially the same size and both slots being large enough to accept one of the socket discs 11. In another embodiment of the present invention, the first slot 32 and the second slot 42 are different sizes and both slots being large enough to accept one of the socket discs 11. In yet two other embodiments of the present invention, the handle 21 includes only a first slot 32 located at the first end 31 or only a second slot 42 located at the second end 41 of the handle 21.

Continuing to refer to FIGS. 5, 6, 7, and 8, the first slot 32 includes a distal end 34 and a distal pin 33. The first slot also includes a proximal end 36 and a proximal pin 35. The distal pin 33 being at the distal end 34 of the first slot 32 extends perpendicularly from the top surface 22 of the handle to the bottom surface 23 of the handle 21. The proximal pin 35 being at the proximal end 36 of the first slot 32 extends perpendicularly from the top surface 22 of the handle 21 to the bottom surface 23 of the handle. The first slot's pins 33, 35 being designed to engage the concave notches 16 on socket discs 11 having larger diameters when the present invention is being used to tighten or loosen a fastener. Embodiments of the present invention include socket discs having various diameters as may be needed to accommodate various sized fasteners. In a preferred embodiment of the present invention the first slot 32 is operationally designed so that its pair of pins 33, 35 engage the notches 16 of a socket disc having a 2½ inch diameter.

Referring to FIGS. 5, 6, 7, and 8, the second slot 42 includes a distal end 44 and a distal pin 43. The second slot also includes a proximal end 46 and a proximal pin 45. The distal pin 43 being at the distal end 44 of the second slot 42 extends perpendicularly from the top surface 22 of the handle 21 to the bottom surface 23 of the handle. The proximal pin 45 being at the proximal end 46 of the second slot 42 extends perpendicularly from the top surface 22 of the handle 21 to the bottom surface 23 of the handle. The second slot's pins 43, 45 being designed to engage the concave notches 16 on socket discs 11 having smaller diameters when the socket disc tool 10 is being used to tighten or loosen a fastener. Embodiments of the present invention include socket discs having various diameters as may be needed to accommodate various sized fasteners. In a preferred embodiment of the present invention the second slot 42 is operationally designed so that its pair of pins 43, 45 engage the notches 16 of a socket disc having a 2 inch diameter. In one embodiment of the present invention the socket disc 11 includes six equally spaced members 14 extending from the body 12 of the socket disc and away from the socket disc's central aperture 13.

Another embodiment of the present invention includes a first group of three socket discs having a diameter of 2½ inches and a second group of three socket discs having a diameter of 2 inches. The first group of socket discs being configured to engage 32 mm, 27 mm, and 24 mm hexagonal bolts. The second group of socket discs being configured to engage 22 mm, 19 mm, and 17 mm hexagonal bolts. Embodiments of the present invention include both metric and standard sized fasteners. In one embodiment, the present invention is directed towards use in the motorcycle industry on bolts and fasteners used therein.

In an embodiment of the present invention the socket discs 11 and the handle 21 of the socket disc tool 10 are manufactured from tempered aluminum and the pins 33, 35, 43, 45 which engage the notched members of the socket discs are made from hardened steel. Other embodiments may include other types of metals and alloys possessing the characteristics and strengths needed when the socket disc tool is used to apply torque to loosen or tighten a fastener.

Embodiments of the present invention may include handles having various lengths. A preferred embodiment of the present invention includes a handle being 12 inches in length.

Now referring to FIGS. 1 to 9, the present invention also includes a method of using a socket disc tool 10 depicted in FIG. 9 comprising the steps of: providing a plurality of socket discs 11, each socket disc 11 including a body 12 which has a central aperture 13 designed to receive and engage a fastener selected from the group consisting of bolts, lag bolts, nuts or a combination thereof; a plurality of members 14 extending from the body 12 and away from the aperture 13, each said member 14 being coplanar to said body 12 and having a first side 15 which is defined by a concave notch 16 and a second side 17 having a linear slope; and a handle 21 including a first end 31, a second end 41, a top surface 22, a bottom surface 23, a first receiving side 24, and a second side 25; a first slot 32 located at the first end 31 of the handle 21 and a second slot 42 located at the second end 41 of the handle 21, each slot 32, 42 extending through the handle 21 from the first receiving side 24 to the second side 25, said first slot 32 being larger than said second slot 42 and both said slots 32, 42 being large enough to accept one of said socket discs 11; said first slot 32 having a pair of pins 33, 35 which pass through said first slot extending from the top surface 22 to the bottom surface 23, said pair of pins 33, 35 being designed to engage a pair of said concave notches 16 on said socket disc 11; and said second slot 42 having a pair of pins 43, 45 which pass through said second slot extending from the top surface 22 to the bottom surface 23, said pair of pins 43, 45 being designed to engage a pair of said concave notches 16 on said socket discs 11; mating a socket disc 11 to said fastener, with the central aperture 13 having a shape and diameter complimentary to that of the fastener and allowing the fastener to be received within the central aperture 13 when the socket disc 11 is placed onto the fastener, such that the concave notches 16 are pointing to the direction in which the socket disc 11 is to be turned; engaging said socket disc 11 with said first slot 32 or said second slot 42 of said handle 21 as specifically shown in FIG. 7 and FIG. 8 such that a pair of concave notches 16 on the socket disc 11 engage pins 33, 35 of the first slot 32 or pins 43, 45 of the second slot 42 as appropriate; and applying torque to said fastener by pulling or pushing the handle 21 to urge the pins 33, 35 of the first slot 32, or the pins 43, 45 of the second slot 42, against the concave notches 16 to loosen or tighten said fastener.

Referring to the method described above, in one embodiment, the socket disc may comprise six equally spaced members 14 extending from the body 12 of the socket disc 11 and away from the socket disc's central aperture 13.

In one embodiment of the above method, the plurality of socket discs 11 includes a first group of socket discs having a diameter of 2½ inches and a second group of socket discs having a diameter of 2 inches, wherein the central apertures 13 of said first group of said socket disc being configured to engage fasteners having a diameter in the range of 20 mm to 40 mm and said second group of said socket discs being configured to engage fasteners having a diameter in the range of 10 mm to 25 mm.

In another embodiment of the above method, the first slot 32 has a distal pin 33 extending perpendicularly from the top surface 22 to the bottom surface 23 of the handle 21 on a distal end 34 of said first slot and a proximal pin 35 extending perpendicularly from the top surface 22 to the bottom surface 23 of the handle 21 on a proximal end 36 of said first slot, and wherein said second slot 42 has a distal pin 43 extending perpendicularly from the top surface 22 to the bottom surface 23 of the handle 21 on a distal end 44 of said second slot 42 and a proximal pin 45 extending perpendicularly from the top surface 22 to the bottom surface 23 of the handle on a proximal end 46 of said second slot.

In another embodiment of the above method, the first slot 32 being operationally designed to engage a socket disc 11 having a diameter of 2½ inches; and wherein the second slot 42 being operationally designed to engage a socket disc having a diameter of 2 inches.

Now referring to FIG. 9 specifically, and to FIGS. 1 to 8 generally, to use the present invention to loosen or tighten a fastener a user selects a socket disc 11 with a central aperture 13 that compliments the shape and size of the subject fastener 50 so that the socket disc will fit securely onto the fastener. The socket disc 11 is placed onto the fastener 50 such that the concave notches 16 on the socket disc are pointing in the direction which the socket disc is to be turned, clockwise or counter clockwise. Next, the handle 21 of the socket disc tool 10 is aligned to receive the socket disc 11 so the par of pins 33, 35 or 43, 45 of the appropriate sized slot, either the first slot 32 or the second slot 42, can engage a pair of notches 16 on the socket disc 11. With the handle 21 engaging the socket disc 11, the user either pushes or pulls on the handle 21 depending on the orientation of the handle with regard to the socket disc 11, to urge the pair of pins 33, 35 or 43, 45 into the cooperating pair of concave notches 16 in order to exert the necessary torque to loosen or tighten the fastener 50. The continued loosening or tightening of the fastener with successive engagements and disengagements of the handle pins 33, 35 or 43, 45 with the socket disc concave notches 16 is achieved by simply lifting the handle 21 such that the handle pins become disengaged from the concave notches and permitting the pins to travel in the opposite direction to engage the next pair of concave notches. In order to change from loosening a fastener to tightening a fastener, or from tightening a fastener to loosening a fastener, the socket disc 11 is simply removed and flipped over to its opposite side so that its concave notches 16 are pointed in the opposite direction when engaging the handle of the socket disc tool. Finally, the handle 21 can be completely disengaged from the socket disc 11 simply by moving the handle in the opposite direction from which the socket disc is being turned to tighten or loosen a fastener.

The socket disc tool of the present invention provides various advantages over conventional socket tools and socket tool sets, as well as conventional open-end wrenches and boxed-end wrenches. The flat design features of the socket discs and the handle permit compact storage these components when arranged on their flat sides. The flat design of the socket disc also permits it to be used in small spaces with little clearance. The manner in which the handle of the socket disc tool engages the socket disc also permits it to be used in small spaces with little clearance. The tightening or loosening of a fastener using the present invention can be reversed without the need of any additional tools by simply by removing the socket disc from the fastener and flipping the socket disc over to its opposite side and replacing the socket disc back onto the fastener. The central aperture can be manufactured in various shapes and sizes in order to accommodate numerous types of fasteners and bolts. The design of the socket disc and the handle permit continuous engagement and turning of the disc socket with the handle when tightening or loosening a fastener. This continuous engagement between the socket disc and the handle can also reduce both the effort and time required to remove, apply, loosen, or tighten a fastener.

Although preferred embodiments of the invention have been described using specific terms, devices, and methods, such description if for illustrative purposes only. The words used are words of description rather than of limitation. It is to be understood that changes and variations may be made by those of ordinary skill in the art without departing from the spirit or the scope of the present invention. In addition, it should be understood that aspects of the various embodiments may be interchanged, either in whole, or in part. Therefore, the spirit and scope of the invention should not be limited to the description of the preferred versions contained herein.

That which is claimed:

1. A socket disc tool comprising:

a plurality of socket discs, each socket disc including:

a body which has a central aperture designed to receive and engage a fastener;

a plurality of members extending from the body and away from the aperture, each said member being coplanar to said body and having a first side which is defined by a concave notch and a second side having a linear slope; and a handle including:

a first slot and a second slot, said first slot being larger than said second slot and both said slots being large enough to accept one of said socket discs;

said first slot having a pair of pins which pass through said first slot, said pair of pins being designed to engage a pair of said concave notches on said socket discs; and said second slot having a pair of pins which pass through said second slot, said pair of pins being designed to engage a pair of said concave notches on said socket discs.

2. The socket disc tool of claim 1, wherein each said socket disc comprises six equally spaced members.

3. The socket disc tool of claim 1, wherein said plurality of socket discs includes a first group of socket discs having a diameter of 2½ inches and a second group of socket discs having a diameter of 2 inches.

4. The socket disc tool of claim 3, wherein the apertures of said first group of said socket discs and the apertures of said second group of said socket discs being configured to receive a fastener selected from the group consisting of bolts, lag bolts, nuts or a combination thereof.

5. The socket disc tool of claim 3, wherein the apertures of said first group of said socket discs being configured to engage fasteners having a diameter in the range of 20 to 40 mm and said second group of said socket discs being configured to engage fasteners having a diameter in the range of 10 mm to 25 mm.

6. The socket disc tool of claim 1, wherein said first slot has a distal pin extending perpendicularly from a top surface to a bottom surface of the handle on a distal end of said first slot and a proximal pin extending perpendicularly from the top surface to the bottom surface of the handle on a proximal end of said first slot, and wherein said second slot has a distal pin extending perpendicularly from the top surface to the bottom surface of the handle on a distal end of said second slot and a proximal pin extending perpendicularly from the top surface to the bottom surface of the handle on a proximal end of said second slot.

7. The socket disc tool of claim 6 wherein said first slot being operationally designed to engage a socket disc having a diameter of 2½ inches; and wherein said second slot being operationally designed to engage a socket disc having a diameter of 2 inches.

8. A socket disc tool comprising:

a plurality of socket discs, each socket disc including:

a body which has a central aperture designed to receive and engage a fastener selected from the group consisting of bolts, lag bolts, nuts or a combination thereof;

a plurality of members extending from the body and away from the aperture, each said member being coplanar to said body and having a first side which is defined by a concave notch and a second side having a linear slope; and a handle including:

a first end, a second end, a top surface, a bottom surface, a first receiving side, and a second side;

a first slot located at the first end of the handle and a second slot located at the second end of the handle, each slot extending through the handle from the first receiving side to the second side, said first slot being larger than said second slot and both said slots being large enough to accept one of said socket discs;

said first slot having a pair of pins which pass through said first slot extending from the top surface to the bottom surface, said pair of pins being designed to engage a pair of said concave notches on said socket discs; and said second slot having a pair of pins which pass through said second slot extending from the top surface to the bottom surface, said pair of pins being designed to engage a pair of said concave notches on said socket discs.

9. The socket disc tool of claim 8, wherein each said socket disc comprises six equally spaced members.

10. The socket disc tool of claim 8, wherein said plurality of socket discs includes a first group of socket discs having a diameter of 2½ inches and a second group of socket discs having a diameter of 2 inches.

11. The socket disc tool of claim 10, wherein the apertures of said first group of said socket discs being configured to engage fasteners having a diameter in the range of 20 mm to 40 mm and said second group of said socket discs being configured to engage fasteners having a diameter in the range of 10 mm to 25 mm.

12. The socket disc tool of claim 8, wherein said first slot has a distal pin extending perpendicularly from the top surface to the bottom surface of the handle on a distal end of said first slot and a proximal pin extending perpendicularly from the top surface to the bottom surface of the handle on a proximal end of said first slot, and wherein said second slot has a distal pin extending perpendicularly from the top surface to the bottom surface of the handle on a distal end of said second slot and a proximal pin extending perpendicularly from the top surface to the bottom surface of the handle on a proximal end of said second slot.

13. The socket disc tool of claim 12 wherein said first slot being operationally designed to engage a socket disc having a diameter of 2½ inches; and wherein said second slot being operationally designed to engage a socket disc having a diameter of 2 inches.

14. The method of using a socket disc tool comprising the steps of:

providing a socket disc tool comprising:

a plurality of socket discs, each socket disc including:

a body which has a central aperture designed to receive and engage a fastener selected from the group consisting of bolts, lag bolts, nuts or a combination thereof;

a plurality of members extending from the body and away from the aperture, each said member being coplanar to said body and having a first side which is defined by a concave notch and a second side having a linear slope; and a handle including:

a first end, a second end, a top surface, a bottom surface, a first receiving side, and a second side;

a first slot located at the first end of the handle and a second slot located at the second end of the handle, each slot extending through the handle from the first receiving side to the second side;

said first slot having a pair of pins which pass through said first slot extending from the top surface to the bottom surface, said pair of pins being designed to engage a pair of said concave notches on said socket discs; and said second slot having a pair of pins which pass through said second slot extending from the top surface to the bottom surface, said pair of pins being designed to engage a pair of said concave notches on said socket discs;

mating a socket disc to said fastener;

engaging said socket disc with said first slot or said second slot of said handle; and applying torque to said fastener to loosen or tighten said fastener.

15. The method of claim 14, wherein said socket disc comprises six equally spaced members.

16. The method of claim 14, wherein said plurality of socket discs includes a first group of socket discs having a diameter of 2½ inches and a second group of socket discs having a diameter of 2 inches.

17. The method of claim 16, wherein the apertures of said first group of said socket disc being configured to engage fasteners having a diameter in the range of 20 mm to 40 mm and said second group of said socket discs being configured to engage fasteners having a diameter in the range of 10 mm to 25 mm.

18. The method of claim 14, wherein said first slot has a distal pin extending perpendicularly from the top surface to the bottom surface of the handle on a distal end of said first slot and a proximal pin extending perpendicularly from the top surface to the bottom surface of the handle on a proximal end of said first slot, and wherein said second slot has a distal pin extending perpendicularly from the top surface to the bottom surface of the handle on a distal end of said second slot and a proximal pin extending perpendicularly from the top surface to the bottom surface of the handle on a proximal end of said second slot.

19. The method of claim 18, wherein said first slot being operationally designed to engage a socket disc having a diameter of 2½ inches; and wherein said second slot being operationally designed to engage a socket disc having a diameter of 2 inches.

* * * * *